United States Patent [19]

Bengtson

[11] Patent Number: 4,624,496

[45] Date of Patent: Nov. 25, 1986

[54] BOOT CARRIER FRAME

[76] Inventor: Rodney L. Bengtson, 7549 E. Irvington, Tucson, Ariz. 85730

[21] Appl. No.: 751,234

[22] Filed: Jul. 2, 1985

[51] Int. Cl.[4] ..... A47F 7/08; B65D 63/18

[52] U.S. Cl. ..... 294/148; 211/34; 294/163; 294/165

[58] Field of Search ..... 294/87.2–87.28, 294/137, 141–144, 146, 148, 149, 151, 153, 157, 159–169, 172; 12/120.5; 211/34–38

[56] References Cited

U.S. PATENT DOCUMENTS

| | | | |
|---|---|---|---|
| 2,092,456 | 9/1937 | Hunker | 294/159 |
| 2,603,393 | 7/1952 | Oblusteel | 12/120.5 X |
| 2,822,208 | 2/1958 | Then | 294/87.2 |
| 3,074,085 | 1/1963 | Salzman . | |
| 3,209,870 | 10/1965 | Johns . | |
| 3,272,413 | 9/1966 | Pfleider . | |
| 3,368,655 | 2/1968 | Purdy . | |
| 3,537,594 | 11/1970 | Daley | 294/162 |
| 3,721,373 | 3/1973 | Penniman . | |
| 3,775,794 | 12/1973 | Fisher | 294/162 X |
| 3,802,572 | 4/1974 | Shackel | 211/38 |
| 4,244,498 | 1/1981 | Copp | 294/162 |
| 4,537,436 | 8/1985 | Pfortmiller | 294/148 X |

FOREIGN PATENT DOCUMENTS

| | | | |
|---|---|---|---|
| 310916 | 5/1929 | United Kingdom | 294/164 |

*Primary Examiner*—Johnny D. Cherry
*Attorney, Agent, or Firm*—J. Michael McClanahan

[57] ABSTRACT

A ski boot carrier frame defining a pair of side by side rectangular openings, a handle connecting to a central member which separates the side by side openings, and a restraining strap adapted to pass across both rectangular openings, the rectangular openings each adapted to receive and secure a ski boot for carrying and storage. The strut members of the boot carrier frame defining both ends of the side by side rectangular openings are angled with respect to each other, and in addition, the rear members defining the rectangle are arcuate in shape to receive the back portion of the boot in a holding relationship. When the boots are inserted into the rectangular openings, the boots are engaged on their soles by the front struts and at the rear by the back of the boot resting on the arcuate rear strut as the boot passes through rectangular opening to be held in such position by the securing strap holding the boots against the carrier frame.

10 Claims, 6 Drawing Figures

BOOT CARRIER FRAME

BACKGROUND OF THE INVENTION

With the popularity of snow skiing has come the inevitable development of attachments and accessories attendant thereto. In particular, because of the size of ski boots, and the fact that there are two, efforts have been directed in the past to devising containers or devices for holding and carrying ski boots. Generally, it is desired that these ski boots be kept together and, if possible, for the boots and carrier to occupy as little space as possible, and certainly not much space over the combined size of the boots themselves. Concerning the first criterion, the developers of ski boot holders and containers have been able to keep the boots fairly close together, at least sole to sole, however, ski boot carriers which are rather compact in size have not been developed. In addition, many ski boot carriers contain complex spring mechanisms to hold the boot in a rigid fixed position by fixing the toe and engaging the heel with a spring force. In addition, other means have been developed where the heel of the boot is held fixed and the toe is engaged by a screw adjustable holding mechanism. Examples of the above ski boot holding devices are shown in the patents to Johns, U.S. Pat. No. 3,209,870; Salzman, U.S. Pat. No. 3,074,085; Penniman, U.S. Pat. No. 3,721,373; Pfleider, U.S. Pat. No. 3,272,413; and Purdy, U.S. Pat. No. 3,368,655.

While all the devices of the above patents accomplish the basic purpose of holding two ski boots relatively close to each other, such is not done with a simple mechanism nor is the resultant carrier and boots compact in size and easily carried and stowed.

Obviously, there exists the need for a ski boot carrier which is simple in construction, easy to manufacture, without complicated mechanisms, compact in size, substantially not much larger than the boots themselves, and provides easy carriage and stowage.

SUMMARY OF THE INVENTION

This invention relates to a ski boot carrier for securing, carrying, and storing ski boots for snow skiers. The invention comprises a rectangular frame defining two side by side rectangular openings adapted to receive the boots in a securing configuration, a handle located upon the central member defining the two rectangular openings, and a restraining strap for securing the boots in place in the rectangular opening. More particularly, the front element forming each rectangular opening is beveled towards the other rectangular opening to point the toes of the boots together to prevent shifting and hold the boots once they are situated in the rectangular openings, and the rear members forming each rectangular openings are arcuate in shape to receive the back portion of the boot to also secure the boot. The boots are situated in each of the rectangular openings such that a portion of the boot passes through the rectangular opening, the sole of the boot resting on the front element of the rectangular base and the rear portion of the boot against the arcuate portion of the rectangle. The restraining strap, connected to the outside of one of the rectangular opening side members, passes through the handle to the far side member defining the other rectangular opening, engaging the top of the boots as it runs from side to side.

The centrally located handle is the means by which the boots are carried. In addition, the handle may be fixed or pivoted, and when pivoted, to lay on its side, and compact the device to occupy very little space when not in use holding the boots.

The side members defining the rectangular opening additionally hold the boots together by engaging the outside portions of each boot as they reside side by side.

It is an object of the subject invention to provide a ski boot carrier which is simple in construction.

It is further an object of the subject invention to provide a ski boot carrier which keeps the boots together and stores the boots in a minimum space.

Other objects of the invention will in part be obvious and will in part appear hereinafter. The invention accordingly comprises the apparatus possessing the construction, combination of elements, and arrangement of parts which are exemplified in the following detailed disclosure, and the scope of the Application which will be indicated in the claims.

BRIEF DESCRIPTION OF THE DRAWINGS

For further understanding of the nature and objects of the present invention, reference should be had to the following detailed description taken in connection with the accompanying drawings wherein.

In the various views, like index numbers refer to like elements.

DETAILED DESCRIPTION OF THE PREFERRED EMBODIMENT

Figure 1:
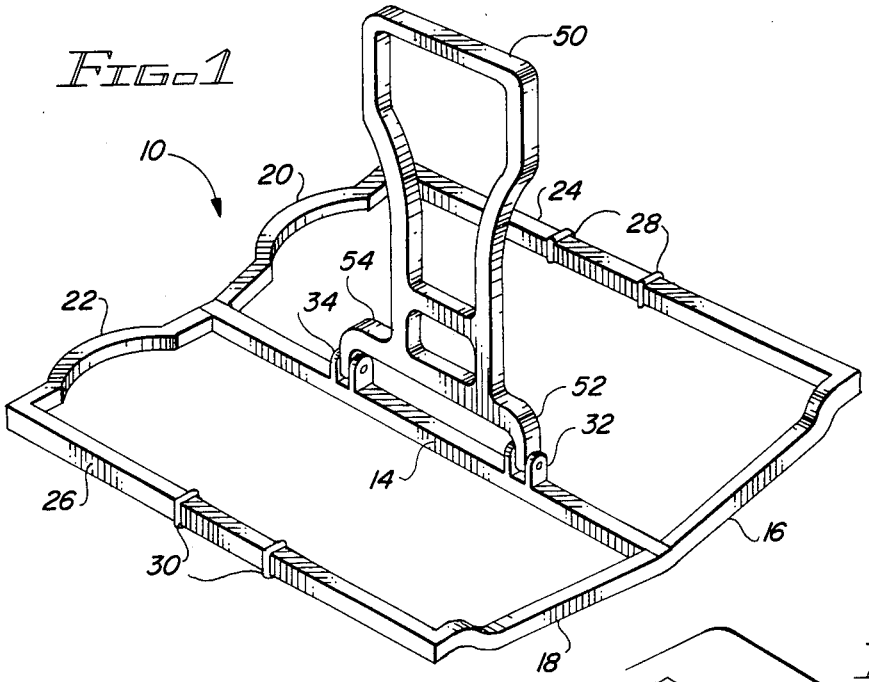
FIG. 1 is a perspective view of the preferred embodiment of the invention.

Referring now to FIG. 1, a perspective view of the subject invention less the holding strap (shown in FIGS. 5 and 6) is detailed. Primarily, the inventive boot carrier frame comprises a rectangular shaped base 10 which in turn is divided into two elongated rectangular openings by a center strut 14, each opening adapted to hold one of the pair of ski boots. Rectangular base 10 comprises, in its forward section, front strut 16 and front strut 18 with elongated side members 24 and 26 situated on opposite sides of center strut 14. At the rear portion of rectangular base 10 are the two outwardly arcuate rear strut 20 and rear strut 22 respectively.

Continuing with FIG. 1, on each of the side members 24 and 26 are generally centrally located and spaced apart nubs or protrusions 28 and 30 respectively. These nubs or protrusions tend to locate and secure the holding strap later defined. Situated near each end of center strut 14 are a pair of spaced apart front and rear tabs 32 and 34 respectively, each of these tabs comprising two upwardly directed fingers adapted to receive, in either a fixed or pivotal relationship, the spaced apart legs of handle 50. More particularly, the fingers which comprise front tabs 32 receive front leg 52 of handle 50 and the two upward protruding spaced apart fingers comprising tabs 34 receive rear leg 54 of handle 50. A single round pin connecting between the spaced apart fingers of tabs 32 provides an axle about which an opening in the forward leg of handle 50 may pivot, and the same arrangement is utilized between the two spaced apart fingers comprising rear tabs 34. In the event that it is desired that handle 50 should not be pivotable, but be fixed, then such pin may be square or other shape and firmly attached to both the spaced apart fingers of tabs 32 and 34, as well as to the front and rear legs 52 and 54 respectively of handle 50.

Figure 6:
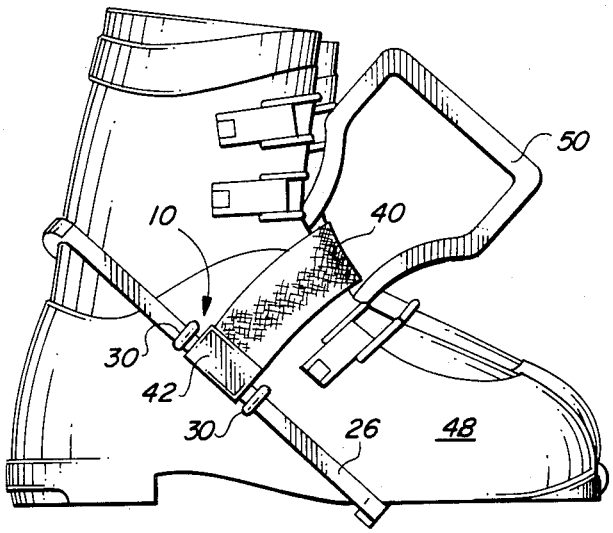
FIG. 6 is a side view of the subject device in use with the ski boots which it secures.

The two rectangular openings formed by the front struts 16 and 18, side members 24 and 26, and central strut 14 of rectangular base 10 are sized as follows. The width of the openings is adapted to be just slightly greater than the width of the ski boots of the range of the sizes the carrier is designed to receive, and the length of the opening somewhat less than the length of the sole only of the ski boot range of sizes. The reason for this is to allow a portion of the boot to reside interiorly to the rectangular openings as shown in FIG. 6, to hold the boots somewhat together, and to provide less space for the boots to shift. It is anticipated that three sizes of boot carrier frames may be utilized, firstly a frame having large rectangular openings for men's boots, a somewhat smaller frame with rectangular openings for ladies' boots, and a still smaller frame with rectangular openings for children's boots.

It is noted that the front struts 16 and 18 form a wide angle "V" which is continued to the rear struts 20 and 22, which also form a wide angle "V". The purpose for each of the openings within the rectangular base 10 of being somewhat beveled with respect to the other is to force the boots to keep their tops together, as well as having the toes and the heels tending to always be sliding towards each other (when the pair of boots are held vertical) rather than having the toe or the heel tend to spread apart. In addition, as can be seen from FIG. 1, at the opposite ends of front struts 16 and 18, the front strut makes an upward bend immediately before it joins with side members 24 and 26. This is also repeated at the rear struts 20 and 22. By raising the side members 24 and 26 slightly upward, the boot is held a little higher on the sides, especially as seen in FIG. 6.

Figure 2:
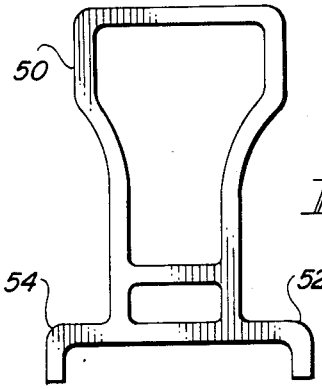
FIG. 2 is a side view of the handle of the subject invention.

Referring now to FIG. 2, a side view of handle 50 is detailed showing in particular the openings in the upper portion of handle 50 adapted to receive the gloved hand of the skier when transporting the inventive boot carrier frame. The width of the handle is so constructed that the opening in the upper portion is of sufficient breadth to receive all four gloved fingers of the skier's hand in order that the fingers may wrap around the upper handle member. At the lower portion of handle 50 are the front and rear legs 52 and 54 respectively which are adapted to reside between the spaced apart fingers comprising tabs 32 and 34 respectively (FIG. 1). It is noted that one size handle for all sizes of ski boot carrier is preferred so that all skier's hands can be accommodated in the opening in the upper handle portion.

Figure 3:
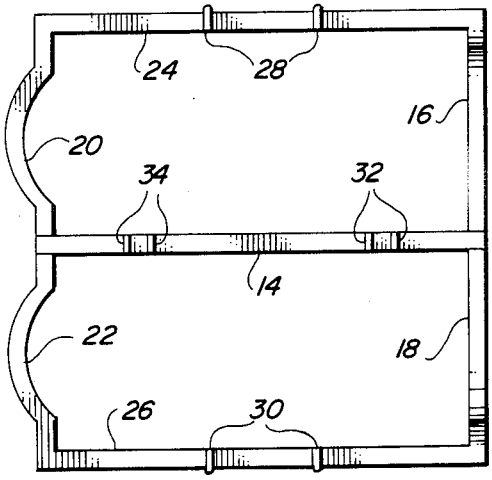
FIG. 3 is a top view of the rectangular base of the subject invention.

Continuing, reference is now made to FIG. 3, a top view of rectangular base 10. Shown in FIG. 3 are the front struts 16 and 18, the side members 24 and 26, central strut 14, and rear struts 20 and 22. FIG. 3 shows the curved arcuate portion of the rear struts 20 and 22 in better view than the perspective drawing of FIG. 1. These curved portions are adapted to receive the rounded rear portions of the boots when they are located in the boot carrier frame (FIG. 6). By utilization of the curved portion, the rear of the boot is held in a position restraining it from side to side motion, and more especially so when the boot is held by the securing strap shown in FIG. 6. On opposite sides of side members 24 and 26 are the nubs or protrusions 28 and 30 adapted to locate and help hold the crossover strap which secures the boots into the rectangular openings. Located along central strut 14 are the pair of spaced apart fingers comprising front and rear tabs 32 and 34 respectively, these tabs adapted to hold and secure the pin which eventually passes through the front and rear legs 52 and 54 respectively of handle 50.

Figure 4:
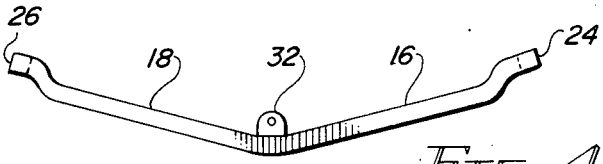
FIG. 4 is a partial front view of the rectangular base.

Referring now to FIG. 4, a front view of front struts 16 and 18 is detailed, showing the beveled or angled nature of each strut relative to the other. As mentioned earlier, each strut terminates in an upward rising curved portion where it connects with the side members 24 and 26. Together, front struts 16 and 18 form a very slight "V". The remaining portion of the invention is not shown in FIG. 4, the purpose of FIG. 4 only to show the beveled relationship of the front struts adapted to lean the ski boots towards each other when they are vertical in order to keep them together rather than permitting the toes to spread. The same analogy applies to the rear portion of the boots since the rear struts also form the same slight "V".

Figure 5:
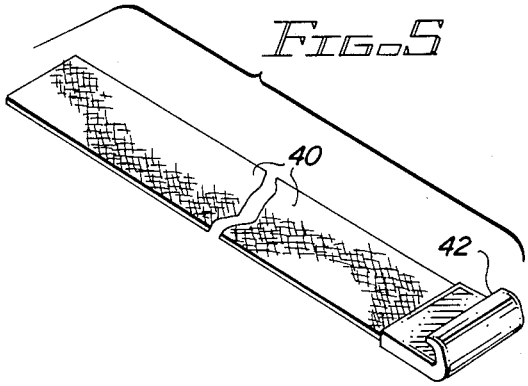
FIG. 5 is a perspective view of the restraining strap.

Continuing on, FIG. 5 shows securing strap 40 which is adapted to be attached at one end to side member 24, and at the strap's other end to hook around side member 26 between nubs 30 by means of clasp 42. In practice, securing strap 40 may be attached to side member 24 at its end opposite clasp 42 by the means of an adhesive, rivets, or any other suitable fastening means.

Finally, FIG. 6 shows the use of the inventive boot carrier frame holding a pair of ski boots 48 in the preferred position. As can be seen from FIG. 6, each boot fits through one of the rectangular openings of rectangular base 10 such that the heel of the boot has passed completely through the opening and the boot is held in place with the rear portion of the boot engaging the arcuate shaped rear struts of rectangular base 10, and the sole of the boots resting upon the front struts of the boot carrier frame at an approximate mid-sole position.

Located between the ski boots is handle 50 with securing strap 40 passing from one side member to the other over the front top portion of both boots and through the opening of handle 50 to reside with clasp 42 hooked over the side member. On either side of clasp 42 are the nubs or protrusions 30 which locate and secure clasp 42 from sliding beyond the area between the two nubs.

In the preferred embodiment of the invention, the rectangular base 10 and the handle 50 may be constructed of most any material, either metal, wood, plastic, or similar material and may be a rigid, semi-rigid, or somewhat flexible structure. The strap 40 which restrains the boots in the rectangular openings is preferably an elastic material which may be a rubber or plastic. Clasp 42 may be made out of the same materials as is rectangular base 10 and handle 50. Nubs or protrusions 28 and 30 are similarily constructed from the same materials as is the rectangular piece 10 and may be separate pieces added to the side members, or can be formed with the side members when they are constructed.

To best utilize the inventive boot carrier frame, the rectangular base 10 is set on a flat surface with the operator holding handle 50 upward (realizing the base will tilt to one side). With strap 40 not connected between both side members, each boot is laid into a rectangular opening of base 10, preferably so that the heel of the boot is one to two inches from the arcuate portion of rear struts 20 and 22. This would place the front struts 16 and 18 to be somewhat near the middle of the sole of each boot. Next, the handle is lifted and as it is, each of the ski boots will fall into each rectangular opening, pivoting about the front strut. The rear portion of each boot will engage the rear strut and the boots will be held in the rectangular frame with the tops angled towards each other. Next, the boots are secured in place by crossing strap 40 through the upper opening of handle 50 to engage the side member 26 with clasp 42. Obviously when the boots are carried, the rectangular frame will find a somewhat horizontal level with the ground, however, the soles of the boots will be at an upward angle with respect to the horizontal.

The inventive boot carrier frames allows boots to be stored in an upright, side by side configuration with the rear heel of the boot and the center point of the front struts engaging the floor. When the boots are absent from the inventive boot carrier frame, the handle 50, if pivotable, may be pivoted to one side or the other in order to compact the device and present as low a profile as possible to facilitate easy storage. Obviously this will not be the case when the handle is fixed in the upward position which is the alternative to a pivotal handle.

It is also appreciated that the subject invention may be utilized for securing, carrying, and storing other types of boots as well as shoes.

While a preferred embodiment of Applicant's invention has been shown and described, it is appreciated that still other embodiments of the invention are possible and that there is no intent to limit the invention by such disclosure, but rather it is intended to cover all modifications and alternate embodiments falling within the spirit and the scope of the invention as defined by the appended claims.

I claim:

1. A ski boot carrier frame for securing a pair of ski boots for transportation and storage comprising:

a pair of side by side openings defined by a central side member common to both openings, a second and third side member parallel to and disposed on opposite sides of said central side member, a first and second front strut member, said first front strut member connecting said central side member to said second side member and said second front strut member connecting said central side member to said third side member, said first and second front strut members angled towards each other, and a first and second rear strut member, said first rear strut member connecting said central side member to said second side member and said second rear strut member connecting said central side member to said third side member, said first and second rear strut members angled towards each other; and a handle operably attached to said central side member whereby when each of the ski boots of the pair is placed in one of the side by side openings to be secured for transportation and storage, the ski boots are inclined towards each other.

2. The ski boot carrier frame as defined in claim 1 wherein a portion of said first and second rear strut members are arcuate in shape, said first and second rear strut members adapted to receive the ski boot within the arcuate portion whereby the ski boot is thereby secured.

3. The ski boot carrier frame as defined in claim 2 wherein said central side member includes a first pair of upwardly directed tabs adapted to receive said handle whereby said handle may be operably attached to said central side member.

4. The ski boot carrier frame as defined in claim 3 further including an elastic strap of two ends, one end of said strap fixedly attached to said second side member and the second end of said strap attachable to said third side member, said strap adapted to secure the ski boots in the side by side openings.

5. The ski boot carrier frame as defined in claim 4 further including a pair of protrusions situated on said third side member, said protrusions adapted to be disposed on opposite sides of said elastic strap second end.

6. The ski boot carrier frame as defined in claim 5 further including a pin attached to said first pair of upwardly directed tabs, and said handle defines an opening adapted to receive said pin in a pivotable relationship whereby said handle may be pivotable upon said central side member.

7. The ski boot carrier frame as defined in claim 6 further including a second pin, said central side member defining a second pair of upwardly directed tabs, said second pin attached to said second pair of upwardly directed tabs, and said handle defining a second opening adapted to receive said second pin in a pivotable relationship whereby said handle may be pivoted upon said central side member.

8. The ski boot carrier frame as defined in claim 5 wherein said pin is fixedly attached to said first pair of upwardly directed tabs, and said handle is fixedly attached to said pin whereby said handle is fixed in relationship to said central side member.

9. The ski boot carrier frame as defined in claim 4 wherein said side by side openings define side by side rectangular openings.

10. A ski boot carrier frame for ski boots of the type having a sole and rear upper part, said ski boot carrier frame adapted to secure a pair of ski boots for transporting and storing comprising:

a pair of side by side openings defined by a central side member common to both openings, a second and third side member parallel to and disposed on opposite sides of said central side member, a first and second front strut member, said first front strut member connecting said central side member to said second side member and said second front strut member connecting said central side member to said third side member, and a first and second rear strut member, said first strut member connecting said central side member to said second side member and said second rear strut member connecting said central side member to said third side member;

said first and second front strut members angled towards each other, said first and second front strut members adapted to receive the ski boot sole;

said first and second rear strut members angled towards each other, said first and second rear strut members defining an arcuate shaped portion adapted to receive the ski boot upper rear part within the arcuate portion;

an elastic strap operably attached between said second and third side members adapted to secure the ski boots; and a handle operably attached to said central side member whereby each of the ski boots of the pair is placed in one of the side by side openings to be secured for transportation and storage.

* * * * *